United States Patent [19]

Wittman et al.

[11] Patent Number: 4,926,751

[45] Date of Patent: May 22, 1990

[54] ARRANGEMENT FOR DRAWING A BRAKING PARACHUTE OUT OF AN ARTICLE OF SUBMUNITION

[75] Inventors: Jurgen Wittman, Nuremburg; Wolfgang von Entress-Fursteneck, Leinburg; Gunther Thurner, Schwaig, all of Fed. Rep. of Germany

[73] Assignee: Diehl GmbH & Co., Nuremburg, Fed. Rep. of Germany

[21] Appl. No.: 371,592

[22] Filed: Jun. 26, 1989

[30] Foreign Application Priority Data

Jul. 11, 1988 [DE] Fed. Rep. of Germany ..... 3823446

[51] Int. Cl.[5] ..... F72B 10/86

[52] U.S. Cl. ..... 102/348; 102/359

[58] Field of Search ..... 102/348, 354

[56] References Cited

U.S. PATENT DOCUMENTS

| | | | |
|---|---|---|---|
| 1,894,954 | 1/1933 | Johnson et al. | 102/4 |
| 3,502,023 | 3/1970 | Britton | 102/35.6 |
| 3,713,387 | 1/1973 | Karp | 102/4 |
| 4,029,014 | 6/1977 | Cunningham | 102/35 R |
| 4,367,680 | 1/1983 | Hart | 102/387 |
| 4,753,171 | 6/1988 | Stessen | 102/387 |
| 4,825,766 | 5/1989 | Ruthen | 102/215 |

FOREIGN PATENT DOCUMENTS 2595811 9/1987 France .

OTHER PUBLICATIONS

European Search Report.

*Primary Examiner*—Peter A. Nelson

*Attorney, Agent, or Firm*—Scully, Scott, Murphy & Presser

[57] ABSTRACT

An arrangement for drawing a braking parachute out of a front article of submunition of a submunition pair, including a withdrawing or pull line extending between the front and rear articles of submunition. Upon the articles of submunition distancing themselves from each other, there is opened a slip knot of the pull line, through which the latter is connected with the rear article of submunition.

4 Claims, 2 Drawing Sheets

ARRANGEMENT FOR DRAWING A BRAKING PARACHUTE OUT OF AN ARTICLE OF SUBMUNITION

BACKGROUND OF THE INVENTION

1. Field of the Invention

The present invention relates to an arrangement for drawing a braking parachute out of a front article of submunition of a submunition pair, including a withdrawing or pull line extending between the front and rear articles of submunition.

2. Discussion of the Prior Art

An arrangement of that type is elucidated in the disclosure of U. S. Pat. No. 4,753,175; issued June 29, 1988, and which is assigned to the common assignee for their application. Subsequent to the expulsion of the submunition from a carrier projectile, the pull line which is connected between the two articles of submunition will tear, through the intermediary of which the braking parachute of the front submunition should be opened, and in proximity therewith. The pull line remains attached at the rear article of submunition. This can readily cause difficulties, inasmuch as the pull line can intertwine itself with a rotational parachute or the braking parachute of the rear submunition.

SUMMARY OF THE INVENTION

Accordingly, an object of the present invention contemplates the provision of an arrangement of the above-mentioned type in which there is avoided the exertion of any influence over the rear article of submunition due to the pull line.

Inventively, the above object is attained for an arrangement of the above-mentioned type, in that the pull line is fastened at the one end thereof to a stowage sack for the braking parachute of the front submunition, and at its other end is connected with the rear submunition by means of a slip knot, and wherein the braking parachute has a further line fastened thereto which engages the slip knot and draw the latter open after the pulling away of the stowage sack from the parachute.

By means of the further line, when the articles of submunition distance themselves from each other, there is opened a slip knot of the pull line, through which the latter is connected with the rear article of submunition. The pull line and also the further line remain then attached to the opened parachute of the front submunition. They cannot exert any influence over the latter. In every instance is there avoided that the pull line or also the further line will remain attached to the rear submunition.

It is also expedient that this arrangement is simple in the construction thereof, as well as in its installation.

Pursuant to a preferred embodiment of the invention, the pull line is constructed hose-like or tubular, and the further line extends as an internal line through the pull line, whereby the inner line is conducted outwardly from the pull line in the region of the slip knot. The internal line can thereby be simply conducted through the stowage pack to the parachute. Consequently, it also cannot intertwine itself with the pull line.

BRIEF DESCRIPTION OF THE DRAWINGS

Further advantageous embodiments of the invention can now be readily ascertained from the following detailed description of an exemplary embodiment thereof, taken in conjunction with the accompanying drawings; in which.

DETAILED DESCRIPTION

Figure 1A:
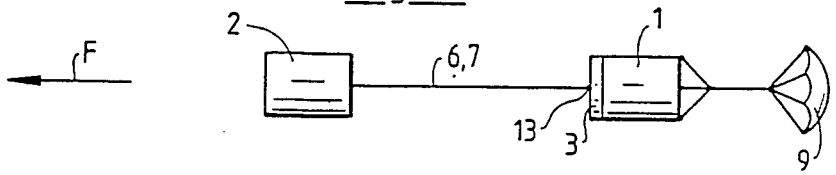
FIGS. 1*a* through 1*c* illustrate three sequential stages during the separation of a pair of submunitions.

Arranged within a carrier projectile (not shown) is a rear article of submunition 1 and a front article of submunition 2 so as to form a pair positioned in close contact with each other. Thereby, a parachute cover 3 of the rear submunition 1 covers the braking parachute 5 of the front submunition 2 which is stored in a stowage sack or packing 4. In the parachute cover 3 there is also located a pull line 6, which has one end thereof fastened to the stowage sack 4 and its other end connected to the parachute cover 3 of the rear submunition 1. The internal line 7 is fastened to the canopy 8 of the braking parachute 5.

Figure 1B:
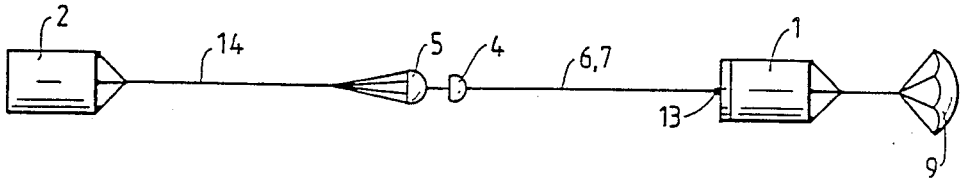
Figure 1C:
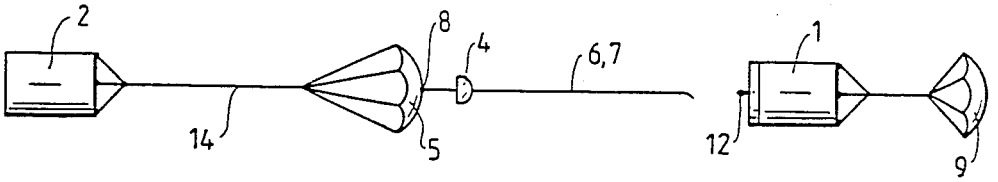
Figure 2:
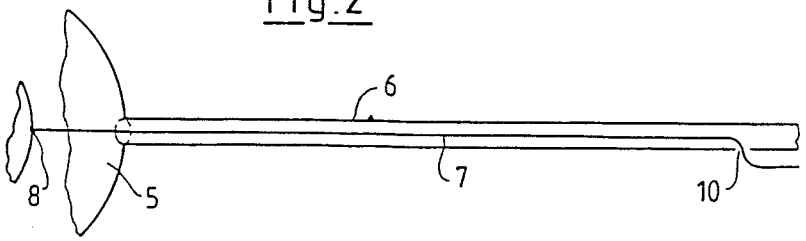
FIG. 2 illustrates the pull line and the further line in the region of the front article of submunition.

The articles of submunitions 1, 2 are expelled from the carrier projectile. Their direction of flight is identified by F in FIG. 1. During expulsion, there opens a braking parachute 9 of the rear article of submunition 1. In consequence thereof, the rear submunition 1 is braked with respect to the front submunition, such that the pull line 6 will tension. This particular condition is shown in FIG. 1*a*, whereby FIGS. 2 and 3 are fragmentary representations shown on an enlarged scale.

The pull line 6 is configured tubular or hose-like. Extending therewithin is the internal line 7, as shown in FIG. 2. The internal line extends through the stowage sack 4 up to the canopy 8. The internal line 7 is conducted out of the pull line 6 through an opening 10. On the parachute cover 3 there is arranged a counterpart 11 which possesses a headpiece 12. With this counterpart 11 the pull line 6 is connected through the intermediary of a slip knot 13, as shown in FIG. 3.

Figure 3:
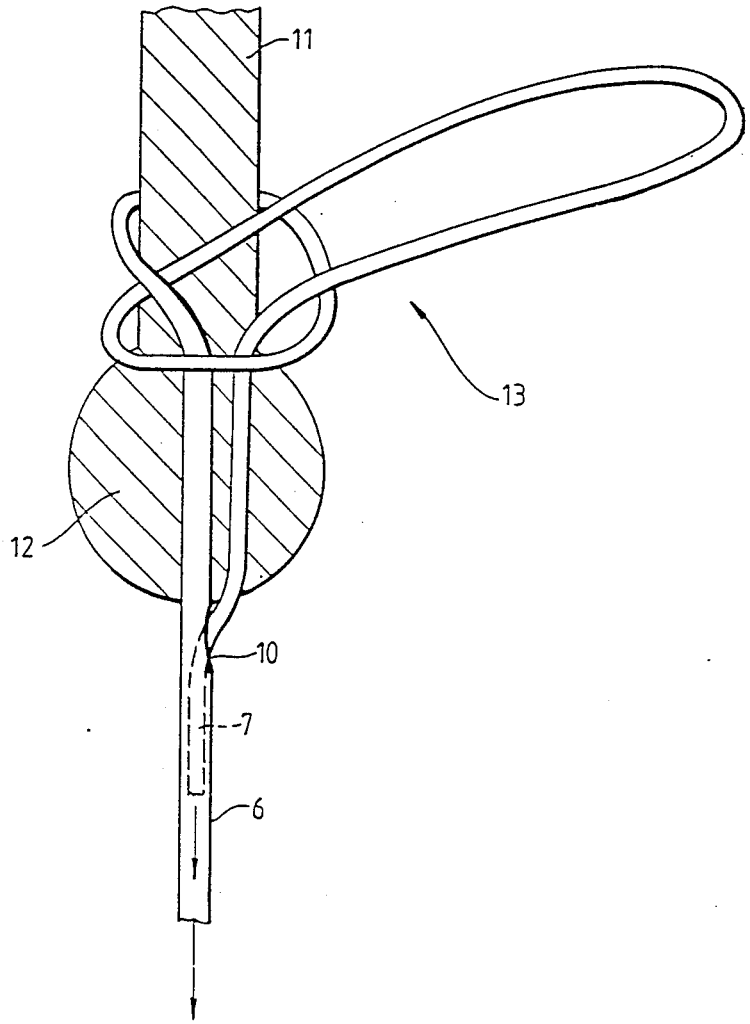
FIG. 3 illustrates the pull line and the further line in the region of the rear article of submunition.

As can be ascertained from FIG. 3, the pull line 6 and the internal line 6 are of a single-piece construction. However, it would also be possible that for the pull line 6 and for the internal line 7 there are respectively provided their own separate pieces. The internal line 7 would then be connected at a suitable location with the slip knot 13 of the pull line 6.

During the course of the continued flight, the stowage sack 4 which on retained at the rear article of submunition 1 detaches itself from the front article of submunition 2 by means of the pull line 6 and its slip knot 13. The braking parachute 5 which is connected therewith by means of a connecting line 14 begins to unfold itself. This condition is illustrated in FIG. 1*b* of the drawings.

At the continued distancing of the front submunition 2 from the rear submunition 1, the braking parachute 5 will unfold itself. Its canopy 8 then pulls against the internal line 7 which, as a result thereof, pulls open the slip knot 13, so that the pull line 6 and the internal line 7 will detach themselves from the counterpart or connector 11 of the rear submunition 1. This condition is illustrated in FIG. 1*c*. The two articles of submunition 1, 2 are then freed from each other. The pull line 6 and the internal line 7 are separated from the rear article of submunition 1. They remain connected with the braking parachute 5 of the front submunition 2, without disturbing the parachute.

What is claimed is:

1. An arrangement for drawing a braking parachute out of a front article of submunition of a pair of submunition articles, including a pull line extending between the front and rear articles of submunition, said pull line having one end fastened to a stowage pack for a braking parachute of the front submunition and having the other end connected through a slip knot with the rear submunition; and a further line being fastened to the braking parachute which engages said slip knot and opens said knot after the drawing of the stowage sack from the parachute, said pull line having a hose-like configuration and said further line extending as an internal line through said pull line, said internalline being conducted outwardly of the pull line in a region proximate the slip knot.

2. An arrangement as claimed in claim 1, wherein said further line is fastened to the canopy of the braking parachute.

3. An arrangement as claimed in claim 1, wherein said pull line and said further line have a single-piece structure.

4. An arrangement as claimed in claim 1, wherein the slip knot is looped about a counterpart with a head on the rear article of submunition.

* * * * *

UNITED STATES PATENT AND TRADEMARK OFFICE

CERTIFICATE OF CORRECTION

PATENT NO. : 4,926,751

DATED : May 22, 1990

INVENTOR(S) : Jurgen Wittmann, et al.

It is certified that error appears in the above-identified patent and that said Letters Patent is hereby corrected as shown below:

Column 1, line 16: "4,753,175" should read as --4,753,171--

Column 4, line 1, Claim 1: "internalline" should read as --internal line--

Signed and Sealed this

Twenty-third Day of July, 1991

*Attest:*

*Attesting Officer*

HARRY F. MANBECK, JR.

*Commissioner of Patents and Trademarks*